US005664585A

United States Patent [19]

Levy et al.

[11] Patent Number: 5,664,585

[45] Date of Patent: Sep. 9, 1997

[54] APPARATUS FOR CUTTING TIE ELEMENTS OF HANDS OF TOBACCO

[75] Inventors: Sam Levy, Richmond; Robert E. Shaw, Midlothian, both of Va.

[73] Assignee: MacTavish Machine Manufacturing Co., Richmond, Va.

[21] Appl. No.: 711,562

[22] Filed: Sep. 10, 1996

[51] Int. Cl.[6] ..... A24B 3/07

[52] U.S. Cl. ..... 131/317; 131/319; 131/290; 83/931; 83/909

[58] Field of Search ..... 131/290, 63, 65, 131/313, 319, 317, 322, 57; 83/931, 663, 909, 343, 346

[56] References Cited

U.S. PATENT DOCUMENTS

| | | | |
|---|---|---|---|
| 2,055,307 | 9/1936 | Priddy | 131/57 |
| 4,566,471 | 1/1986 | Kumasako et al. | 131/290 |
| 5,301,582 | 4/1994 | Bragaglia | 83/338 |
| 5,400,493 | 3/1995 | Hall | 83/909 |

*Primary Examiner*—Aaron J. Lewis
*Assistant Examiner*—Charles W. Anderson
*Attorney, Agent, or Firm*—Norman B. Rainer

[57] ABSTRACT

Method and apparatus for removing tie elements from hands of tobacco leaves on a conveyor belt involve a rotating drum having radially emergent cutting blades that contact the tie elements without contacting the belt. The axle of the drum is disposed at an angle to the direction of belt travel, and the blades are disposed at a compensatory angle with respect to the axle, whereby the drum provides an advancing effect on the leaves, yet the blades cut along the mid-rib of the leaves.

9 Claims, 3 Drawing Sheets

APPARATUS FOR CUTTING TIE ELEMENTS OF HANDS OF TOBACCO

BACKGROUND OF THE INVENTION

1. Field of the Invention

This invention relates to preliminary processing of cured tobacco leaves for the purpose of making them into tobacco products such as filler for cigarettes.

2. Description of the Prior Art

The processing of tobacco leaves as conventionally practiced involves the treatment of the cured dry leaves by a stripping or threshing operation in a machine which separates the stem portion from the lamina. The tobacco leaves are brought into the stemmery factory in bundles referred to as "hands." Each hand consists of a plurality of leaves oriented so that the tips and butts of the leaves are at opposite extremities of the bundle. Another tobacco leaf, referred to as a "tie-leaf" is wrapped around the butt extremity with the free end of the tie-leaf tucked in between the butts of two adjacent leaves, said tie-leaf having been earlier applied to hold the bundle intact during curing of the leaves.

The hands, which may be of non-uniform length, are separately deposited upon a feed-in conveyor belt leading to a stemming machine, forming a substantially parallel array wherein the butt extremities are directed toward the same edge of the belt and the tip extremities are properly positioned at the opposite edge of the belt for severance or "tipping." The tips of the leaves, which may represent almost half the leaf, are processed separately from the rest of the leaves, thereby reducing unnecessary breakage and damage to the lamina in the tips that would be caused by threshing.

Several general techniques have been employed for separating the individual leaves of the hand on the feed-in belt before entering the stemming machine. In one technique, the butt extremities, containing the tie leaf are transversely severed and routed to a separate processing operation. In another technique, as described in British Patent 2,290,694 to Silva, the tie leaves are cut by passage of the butt extremity between opposed cylinders having a multitude of axially parallel blades that are forced into the tie leaves of the bundles. One advantage of the use of blade-holding cylinders is that the elongated blades cover a large lateral zone of the width of the belt. This more assuredly contacts the butt extremities which are not aligned with respect to the edge of the belt. The interactive cylinders further prevent any obstructing-type of accumulation of bundles upon the belt awaiting the tie-leaf removal operation. A problem, however, with Silva's cylinder-mounted blade technique is that it's pressing mechanism of cutting is inefficient, requiring extremely sharp blades and rigorous monitoring of rotational speed and cylinder force.

Another method for separating the leaves of the hands on the feed-in belt is described in U.S. Pat. No. 2,055,307 to Priddy wherein a series of blades radially emergent from shafts parallel to the running direction of the belt cut the tie leaf in a path aligned with the long axis of the bundle. The direction of rotation of the blades is such that the cutting edge of the blade, at the instant of contact with the tie leaf, is travelling away from the tip extremity and toward the butt extremity of the hand. Although the Priddy apparatus represents an efficient cutting mechanism, the effective or "footprint" zone on the belt is very narrow. Accordingly, hands which are slightly misaligned on the belt might be skipped by the rotating blades.

It is to be further noted that, in both the Silva and Priddy approaches to leaf separation, the butt extremities of the hands are acted upon from both above and below. This requires that the butt extremities of the hands are unsupported from beneath while nevertheless continuing their advancement toward the thresher. This is accomplished in the Priddy apparatus by the use of three separate advancing belts plus an advancing chain disposed in a tie-removing region between two of said belts. Silva similarly employs an advancing chain to carry the hands away from a conveyor belt and through a tie-removing region. Such specialized carrying and advancing means require careful synchronization of the several interactive features, and contributes further to the complexity of the apparatus.

The use of rotating drums positioned at an angled relationship to an advancing series of tobacco hands is disclosed in U.S. Patent to Michaux, wherein vertically hung hands are cleaned of debris by passage between two drums having beater cloths.

It is accordingly an object of the present invention to provide apparatus for removing tie elements from the butt extremities of sequential hands of tobacco being transported upon a moving belt.

It is another object of this invention to provide apparatus as in the foregoing object which cuts said tie elements within a relatively wide lateral zone on said belt.

It is a further object of the present invention to provide apparatus of the aforesaid nature which prevents accumulation of hands upstream of the cutting mechanism.

Still further objects of this invention are to provide apparatus of the aforesaid nature of reliable performance and relatively simple construction amenable to low cost manufacture.

These objects and other objects and advantages of the invention will be apparent from the following description.

SUMMARY OF THE INVENTION

The above and other beneficial objects and advantages are accomplished in accordance with the present invention by a cutting apparatus associated with a continuous transport belt of uniform width measured between parallel first and second edges and having an upper running surface which conveys sequential hands of tobacco leaves having a tying element at the butt extremity, said hands being aligned such that said butt extremities are adjacent said first edge of the belt, said apparatus comprising:

a) a cylindrical cutting drum terminating in opposed extremities that are leading and trailing with respect to the direction of motion of said belt, said drum fixedly mounted upon a center axle that extends from said trailing extremity to a distal end, b) a series of uniformly spaced identical arcuate cutting blades radially emergent from said drum, c) means for rotatively supporting said drum from the distal end of said axle in a manner such that:

1) said axle is parallel to said upper running surface, 2) said blades are disposed adjacent said first edge of said belt at an elevation sufficient to contact said tying elements, and 3) said axle is disposed at an angle of between 5 and 10 degrees with respect to said first edge of said belt, said angle opening in the downstream direction of belt travel, d) means for rotating said drum about said axle at a speed sufficient to achieve cutting of said tying elements, and e) an anvil surface disposed below said belt in sliding contact therewith and in opposing juxtaposition with said drum.

In preferred embodiments of the apparatus, a moving hold down device may be downwardly interactive with said upper running surface to restrict lateral movement of the tobacco leaves adjacent the cutting drum. The rotative speed of the drum, and its elevational and angular positioning are preferably adjustable.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 2:
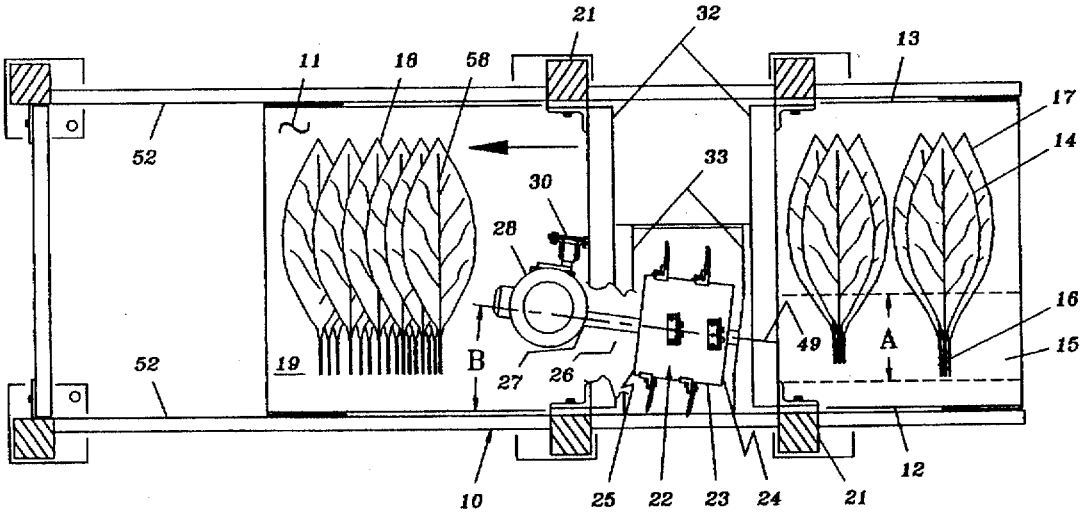
FIG. 2 is a sectional view of the apparatus of FIG. 1 taken in the direction of the arrows upon the lines 2—2 of FIG. 1.

Referring now to FIGS. 1–5, an embodiment of the cutting apparatus 10 of the present invention is shown in operative association with a horizontally disposed continuous belt 11 moving in the direction shown by the arrow. The belt has a uniform width, as measured between parallel first and second edges 12 and 13, respectively, and is driven and supported by rollers 20 secured by paired side plates 52 attached to upright framework 21. The belt may be further characterized in having an upper running surface 44 and lower return surface 45. The belt may typically operate at a linear speed up to 180 feet/minute. Framework 21 is secured to a concrete floor 53 by way of anchoring bolts 54.

Hands of tobacco leaves 14 are entered onto the upstream extremity 15 of belt 11, said hands being secured with tie elements 16 which may be a tobacco leaf, string or other tying agent. The entering hands are in substantially parallel alignment wherein the tip extremities 17 face second edge 13 and butt extremities face first edge 12. It is to be noted that butt extremities of the hands are not necessarily aligned in a straight line. Instead, there is some randomness of location of the hand laterally with respect to the edges of the belt. In any event, however, all the tie elements 16 are disposed within a lateral zone designated by reference letter A. It is to be further noted that, upon emergence from apparatus 10, the tobacco is in the form of separated leaves 18 which retain their original alignment on the downstream portion 19 of the belt.

Figure 4:
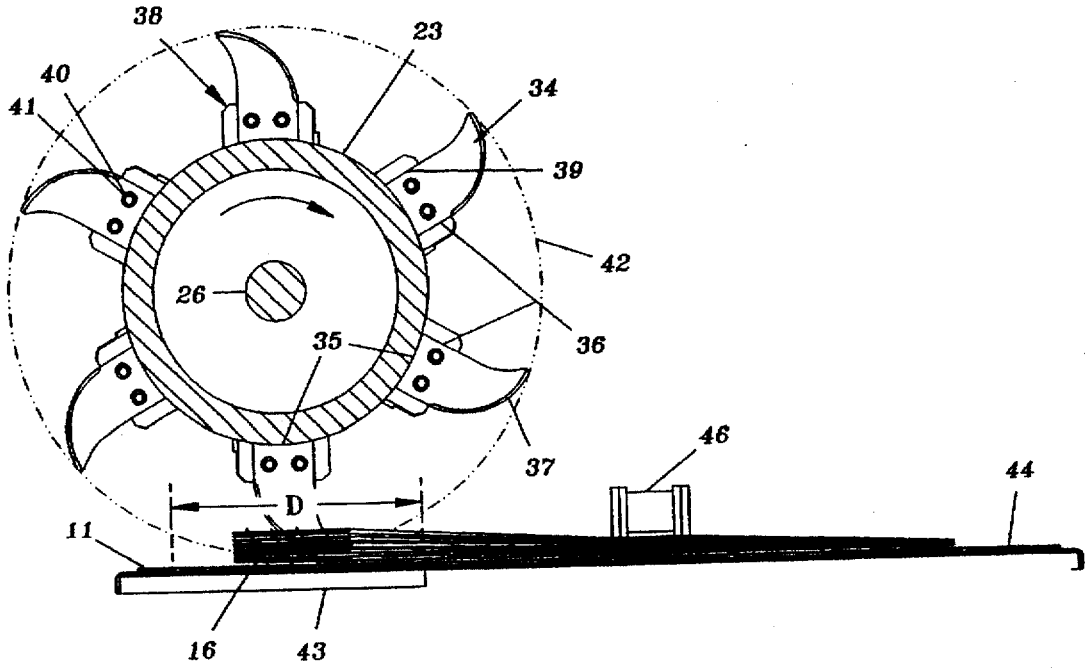
FIG. 4 is an enlarged end view of the drum component of the apparatus of FIG. 1.

Apparatus 10 is comprised of drum 22 having an outer surface 23 that is of circular cylindrical shape with respect to a center axis 49, and further having leading and trailing extremities 24 and 25 respectively. The drum is fixedly centered upon axle 26 centered upon axis 49. The axle further extends from said trailing extremity to distal end 27. As best shown in FIG. 4, a series of uniformly spaced identical cutting blades 34 is radially emergent from cylindrical surface 23.

Figure 1:
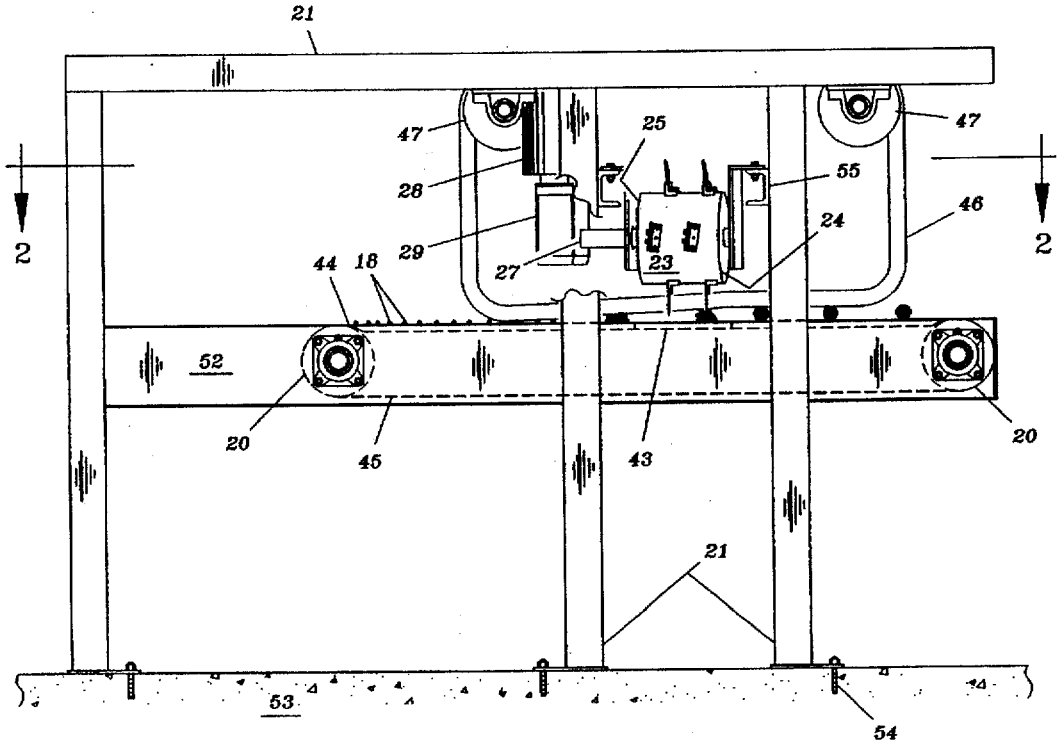
FIG. 1 is a side view of an embodiment of the cutting apparatus of this invention shown in operative association with a moving belt carrying aligned hands of tobacco leaves, portions being broken away to reveal otherwise hidden details.
Figure 3:
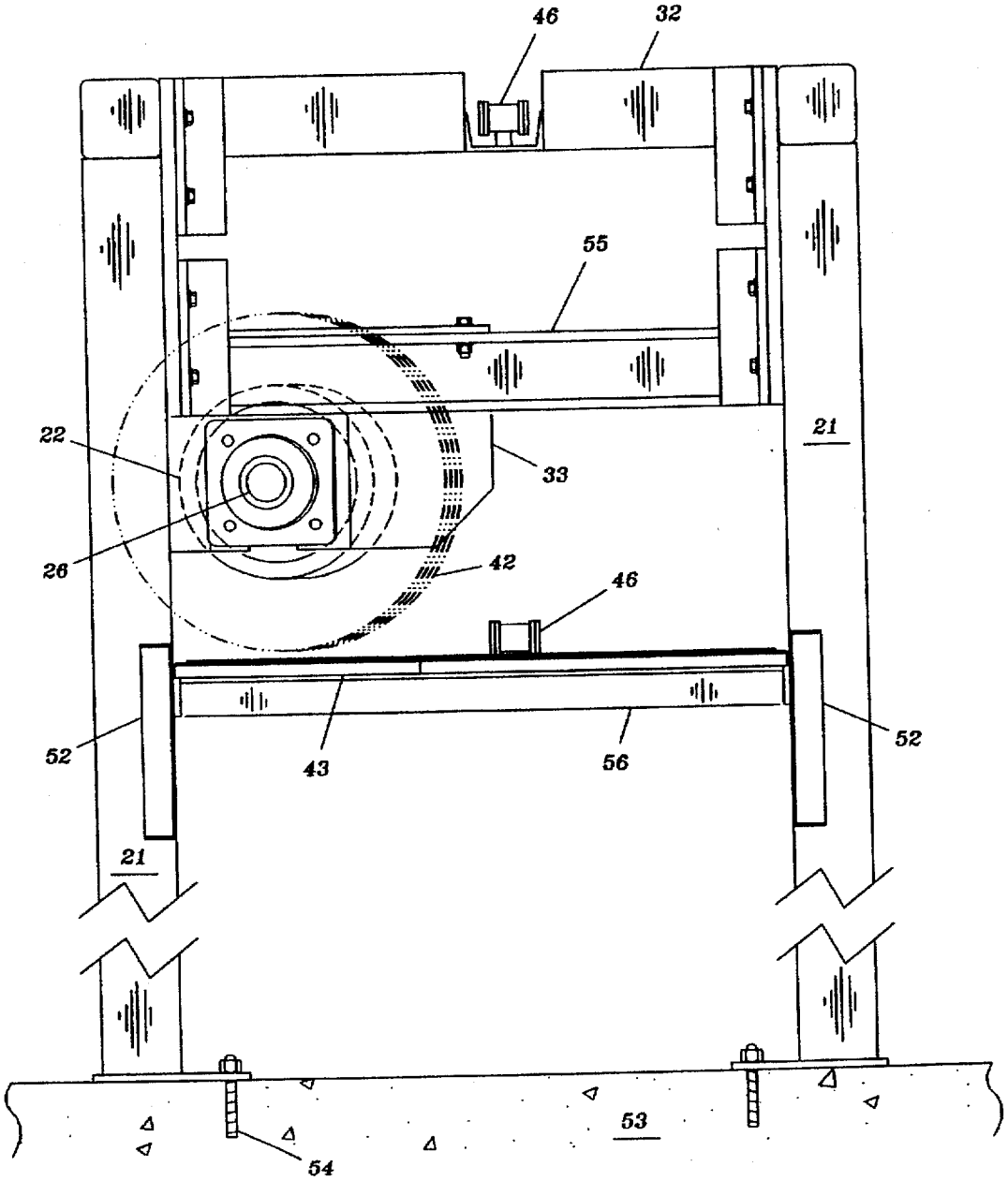
FIG. 3 is a fragmentary end view taken from the right of FIG. 1.
Figure 5:
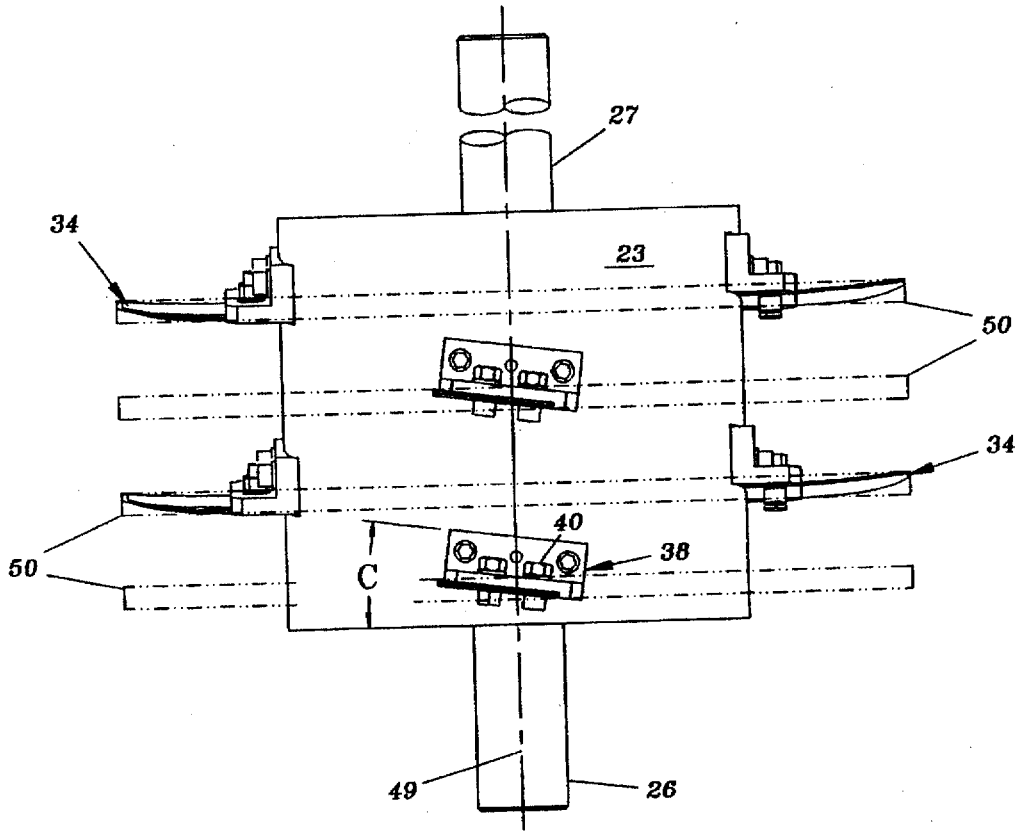
FIG. 5 is an enlarged top view of the drum component of the apparatus of FIG. 1.

An electric motor 28 is adapted to rotate axle 26 by engagement with distal end 27. The drum may typically rotate at adjustable speeds not to exceed 300 r.p.m., the exact speed being interdependent upon the velocity of the belt. In the exemplified embodiment, as illustrated in FIGS. 1 and 2, motor 28 is vertically disposed, and drives axle 26 by way of right angle adapter 29. The advantage of the vertical disposition of the motor is that it places the motor above drum 22, affording greater access to the region of belt immediately downstream from the cutting apparatus. Motor 28 is supported by clamp 30 attached to one of the paired uppermost transverse beams 32 which are supported by framework 21.

Drum 22 is pendently supported by intermediate transverse beams 55 by way of downwardly directed paired embracing plates 33 that rotatively engage the leading and trailing extremities of the drum. Such manner of support permits the adjustable positioning of drum 22 at controllable elevations above belt 11 while maintaining axle 26 parallel to the upper running surface of said belt.

When the drum is properly positioned in the illustrated embodiment, axle 26 will be disposed at an angle of inclination B of between 5 and 10 degrees with respect to first edge 12 of said belt, said angle opening in the downstream direction of belt travel. By virtue of the angled relationship of the drum with respect to the first edge of the belt, the blades define separate footprint areas which additively produce cutting zone A shown in FIG. 2. Cutting zone A accordingly has a relatively wide area of coverage, which is better suited to cope with the somewhat erratic lateral locations of the tie elements 16.

The angled relationship of drum 22 has the further advantage of serving to advance the hands during their transport upon the belt. Such advancing effect prevents the build-up of tobacco leaves adjacent the leading extremity of the drum.

The exemplified embodiment shows 12 identical blades located within four spaced apart orthogonally circumferential paths 50. Within each path, the blades are equidistantly separated in a manner to impart centrifugal balance to the cutter drum. In alternative embodiments, the blades may be disposed in two, three or five circumferential paths. Blade 34 is comprised of a base edge 35 that is slightly convex to match the curvature of the drum, paired straight side edges 36, and a sharpened arcuate cutting edge 37. The blades, preferably flat, are positioned such as to lie within paths 50, and are radially perpendicular to axis 49 but are turned at a pitch angle C with respect to the leading and trailing extremities of the drum. Angle C is carefully selected to be equal to the aforementioned angle B. Cutting edge 37 is also a leading edge, as indicated by the arrow showing the rotational direction of drum 22, and all said cutting edges are oriented in the same direction. The blades are removably secured to surface 23 by way of holder brackets 38 attached to surface 23. Said blades are seated within brackets 38 in a manner such that base edge 35 abuts surface 23 and side edges 36 abut opposed shoulders 39 of brackets 38. Securement of the blades to brackets 38 is achieved by bolts 40 which penetrate receiving apertures 41 in the blade and threadably engage said bracket. It is to be noted that, because of the angled relationship of the blades with respect to axis 49, the blades rotate in planes perpendicular to the belt surface and belt edges when the drum axis is angled in the aforesaid manner with respect to the running direction of the belt. Accordingly, the cutting action is along the mid rib line 58 of the tobacco leaves, namely a line extending between the tips and butts.

When drum 22 is at proper elevational adjustment, the cutting edges 37 of said blades will contact tie elements 16 without contacting belt 11. The region of cutting is substantially the tangential footprint area of the blade, and may be represented by distance D in FIG. 4 which may be defined as the length of the chord that the hand establishes with the circle of revolution 42 of the tips of the blades. It is also to be noted that the cutting action in the exemplified embodiment is in the direction going from the tip to butt extremity of the hand, namely in the direction going from the second to first edges of the belt.

An anvil surface in the form of plate 43 is disposed below upper running surface 44 of belt 11 in sliding contact therewith and in opposing juxtaposition with drum 22. Plate 43 is supported by attachment to paired lowermost transverse beams 56. The purpose of plate 43 is to prevent deflection of the belt by the action of the cutting blades.

In the exemplified embodiment, a continuous loop chain 46 is adapted to travel in a vertical path in a manner to rest atop the tobacco and minimize movement thereof during the tie cutting operation. The chain is caused to pass around rollers 47, at least one of which is motor-driven. The weight of the chain, and the fact that its lowermost portion rides upon the belt in the same direction of motion and at the same speed as the belt, provides the sought transient holding effect upon the tobacco leaves.

By virtue of the aforesaid components and their critically interactive characteristics, the apparatus of this invention provides for the removal of tie elements from sequential hands of tobacco which may be in uneven lateral alignment, and involves the use of just a single conveyor belt. Furthermore, because of the advancing nature of the cutting drum, no tobacco leaves accumulate at the site of cutting.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described our invention, what is claimed is:

1. A cutting apparatus associated with a continuous transport belt of uniform width measured between parallel first and second edges and having an upper running surface which conveys sequential hands of tobacco leaves having a tying element at the butt extremity, said hands being aligned such that said butt extremities are adjacent said first edge of the belt, said apparatus comprising:

a) a cylindrical drum terminating in opposed extremities that are leading and trailing with respect to the direction of motion of said belt, said drum mounted upon a center axle that extends from said trailing extremity to a distal end, b) a series of uniformly spaced identical blades radially emergent from said drum, c) means for rotatively supporting said drum from the distal end of said axle in a manner such that:

1) said axle is parallel to said upper running surface, 2) said blades are disposed adjacent said first edge of said belt at an elevation sufficient to contact said tying elements, and 3) said axle is disposed at an inclination angle of between 5 and 10 degrees with respect to said first edge of said belt, said angle opening in the downstream direction of belt travel, d) means for rotating said drum about said axle at a speed sufficient to achieve cutting of said tying elements, and e) an anvil surface disposed below said belt in sliding contact therewith and in opposing juxtaposition with said drum.

2. The cutting apparatus of claim 1 further comprising tobacco holding means downwardly interactive with said upper running surface to restrict movement of tobacco leaves adjacent said cutting drum.

3. The cutting apparatus of claim 2 wherein said holding means is a continuous loop chain disposed in a vertical plane and adapted to contact said upper running surface and ride thereupon in the same direction and at the same speed as said upper running surface.

4. The cutting apparatus of claim 1 wherein said blades have an arcuate cutting edge.

5. The cutting apparatus of claim 4 wherein said blades are oriented such that all said cutting edges face in the same general direction of rotation of said drum.

6. The cutting apparatus of claim 5 wherein said blades are positioned such that said cutting edges are displaced toward the leading extremity of said drum, whereby the blades are disposed at a pitch angle of between 5 and 10 degrees with respect to said axle, the magnitude of said pitch angle being the same as the magnitude of said inclination angle.

7. The cutting apparatus of claim 6 wherein the position and configuration of said drum and blades are such that said blades are perpendicular to said upper running surface and first edge at the instant of contact of said blades with said tying element.

8. A cutting device for use in apparatus associated with a continuous transport belt of uniform width measured between parallel first and second edges and having an upper running surface which conveys sequential hands of tobacco leaves having a tying element at the butt extremity, said hands being aligned such that said butt extremities are adjacent said first edge of the belt, said cutting device comprising:

a) a drum having an outer surface of circular cylindrical shape with respect to a center axis, leading and trailing extremities, and an axle centered upon said axis, and b) a plurality of identical flat blades radially emergent from said outer surface in removable engagement therewith, and located in a manner to preserve centrifugal balance of said cutter device with respect to rotation about said axle, said blades having an arcuate cutting edge, all of which being oriented in the same rotative direction, and said blades are disposed at an angle of between 5 and 10 degrees with respect to said axis.

9. A process for removing tying elements from the butt extremities of hands of tobacco being transported upon a continuous belt of uniform width measured between parallel first and second edges, said hands being aligned such that said butt extremities are adjacent said first edge of the belt, said process comprising:

a) contacting said tying elements with arcuate cutting edges of blades that are radially emergent from a cylindrical drum having a leading extremity and rapidly rotating about a center axis disposed at an angle of between 5 and 10 degrees with respect to said first edge, said blades being positioned at an angle between 5 and 10 degrees with respect to said axis such that said cutting edges are displaced toward said leading extremity, the direction of rotation of said drum being such as to cause said blades to cut said tying elements in a direction going from the second to the first edge of said belt, b) providing support for the belt beneath said drum to resist downward force produced by said blades, and c) holding said tobacco leaves during contact of said tying elements with said blades to minimize movement of the tobacco.

* * * * *